United States Patent [19]

Sung et al.

[11] Patent Number: 4,557,848

[45] Date of Patent: Dec. 10, 1985

[54] CRANKCASE LUBRICANT

[75] Inventors: Rodney L. Sung, Fishkill; Benjamin H. Zoleski, Beacon; William M. Sweeney, Wappingers Falls, all of N.Y.; Wheeler C. Crawford, Houston, Tex.

[73] Assignee: Texaco Inc., White Plains, N.Y.

[21] Appl. No.: 559,566

[22] Filed: Dec. 8, 1983

[51] Int. Cl.[4] ..... C10M 1/32

[52] U.S. Cl. ..... 252/51.5 R; 252/51.5 A

[58] Field of Search ..... 252/51.5 R; 564/505

[56] References Cited

U.S. PATENT DOCUMENTS 3,231,619 1/1966 Speranza ..... 564/505

4,438,022 3/1984 Campbell ..... 252/51.5 R

*Primary Examiner*—Jacqueline V. Howard

*Attorney, Agent, or Firm*—Robert A. Kulason; Carl G. Seutter

[57] ABSTRACT

A marine diesel crankcase lubricant characterized by decreased haze and increased corrosion inhibition contains an additive typified by $$n\text{-}C_4H_9[OCH_2CH_2]_4[OCH_2\underset{\underset{CH_3}{|}}{C}H]_2NH_2$$

14 Claims, No Drawings

CRANKCASE LUBRICANT

FIELD OF THE INVENTION

This invention relates to crankcase lubricants. More particularly, it relates to marine crankcase lubricant compositions characterized by decreased haze and by increased corrosion inhibition.

BACKGROUND OF THE INVENTION

As is well known to those skilled in the art, lubricating oils must be characterized by resistance to oxidation, by freedom from haze, and by rust inhibition. Since the oils used as lubricants in the crankcase of large, slow-speed, marine diesel engines are subject to unique conditions of operation, special attention must be directed to the potential problems which are to be encountered. These oils are typically formulated to contain anti-wear additives, oxidation inhibitors, demulsifying agents, rust-inhibitors, etc. Illustrative oils may include those of U.S. Pat. No. 4,358,386 or U.S. Pat. No. 4,375,418 inter alia.

It is found however, that prior art marine diesel crankcase oils are frequently characterized by haze problems caused by the presence of the rust inhibitor component. This is undesirable because it masks or interferes with determination of the presence in the oil of undesirable components including decomposition products, water, or solid particles.

It is an object of this invention to provide a novel crankcase lubricant. It is another object to provide a novel lubricant composition, suitable for use in slow speed marine diesel engine, characterized by its rust inhibition and haze-free properties. Other objects will be apparent to those skilled in the art.

STATEMENT OF THE INVENTION

In accordance with certain of its aspects, this invention is directed to a crankcase lubricating oil composition comprising (i) a major portion of a mineral lubricating oil; and (ii) a minor, effective rust-inhibiting amount of $$R[OCH_2CH_2]_a[OCH_2\underset{\underset{CH_3}{|}}{C}H]_bNR_2'$$

wherein R is alkyl, aralkyl, alkaryl, aryl, or cycloalkyl, R′ is hydrogen or alkyl, a is 1–10, and b is 1–15.

DESCRIPTION OF THE INVENTION

The crankcase lubricating oils which may be treated by the process of this invention may include lubricating oils which are employed in diesel engines and particularly in the crankcase of large, slow-speed diesel engines such as are found in marine service. These engines are typically large, slow speed, single acting, two-stroke engines characterized by the fact that the combustion zone is separate from the crankcase zone; and the lubrication requirements of these two zones are satisfied by different lubricating oils.

The crankcase lubricant is typically a hydrocarbon lubricating oil having a Total Base Number of 3–8, say 6 made up for example by blending a paraffinic solvent neutral oil (SNO-20) having a VI of ca 92 and a viscosity of 47–53 SUS at 40° C. and 6.65–7.15 at 100° C. with a paraffinic Solvent Neutral Oil (SNO-50) having a VI of ca. 93 and a viscosity of 158–180 SUS at 40° C. and 15.3–16.4 at 100° C.

Typically the crankcase lubricating oil may contain additives including the following:

TABLE I

| Additive Function | Broad Range w % | Illustrative Addditive |
|---|---|---|
| Anti-wear Agent | 0.1–1 | Zinc dialkyl dithiophosphate |
| Oxidation Inhibitor | 0.1–1 | alkylated diphenyl amine |
| Demulsifying Agents | 50–200 ppm | dimethyl polysiloxane (a silicone) |
| Detergent | 1–5 | Overbased sulfurized calcium alkylphenolate |
| Anti-Rust Agent | 0.1–5 | Ethoxylated nonyl phenol |

In practice of this invention, there may be added to the crankcase lubricating oil, as an anti-rust agent, a minor, effective, rust-inhibiting amount of $$R[OCH_2CH_2]_a[OCH_2\underset{\underset{CH_3}{|}}{C}H]_bNR_2'$$

wherein R is alkyl, aralkyl, alkaryl, aryl, or cycloalkyl, R′ is hydrogen or alkyl, a is 1–10, and b is 1–15.

In the above formula, R may be a hydrocarbon radical selected from the group consisting of alkyl, aralkyl, cycloalkyl, aryl, and alkaryl, including such radicals when inertly substituted. When R is alkyl, it may typically be methyl, ethyl, n-propyl, iso-propyl, n-butyl, i-butyl, sec-butyl, amyl, octyl, decyl, octadecyl, etc. When R is cycloalkyl, it may typically be cyclohexyl, cycloheptyl, cyclooctyl, 3-methylcycloheptyl, 3-butylcyclohexyl, 3-methylcyclohexyl, et. When R is alkaryl, it may typically be tolyl, xylyl, etc. When R is aryl, it may be phenyl, naphthyl, etc. R may be inertly substituted i.e. it may bear a non-reactive substituent such as alkyl, aryl, cycloalkyl,ether, etc. Typically inertly substituted R groups may include 3-methoxylpropyl, 2-ethoxyethyl, carboethoxymethyl, 4-methylcyclohexyl, p-methylphenyl, p-methylbenzyl, 3-ethyl, 5-methylphenyl, etc. The preferred R groups may be $C_1$–$C_{12}$ alkyl groups including eg butyls, amyls, hexyls, octyls, decyls, etc. R may preferably be n-butyl.

In the above formula, R′ is an alkyl group typically one containing 2–3 carbon atoms, or more preferably R′ is hydrogen. Both R′ groups need not be the same. Preferably both R′ groups are hydrogen; a may preferably be an integer 1–10, preferably 1–4 say 4; and b may preferably be an integer 1–15, preferably 1–9, say 2.

Illustrative compositions which may be employed may include the following, the first listed being preferred:

TABLE II

A. $n\text{-}C_4H_9\,[OCH_2CH_2]_4\,[OCH_2\underset{\underset{CH_3}{|}}{C}H]_2\,NH_2$ B $CH_3\,[OCH_2CH_2]_4\,[OCH_2\underset{\underset{CH_3}{|}}{C}H]_2\,NH_2$ C $n\text{-}C_4H_9\,[OCH_2CH_2]\,[OCH_2\underset{\underset{CH_3}{|}}{C}H]_9\,NH_2$ TABLE II-continued

| | |
|---|---|
| D | $C_2H_5[OCH_2CH_2]_4[OCH_2\underset{\underset{CH_3}{\vert}}{CH}]_2NH_2$ |
| E | $CH_3[OCH_2CH_2][OCH_2\underset{\underset{CH_3}{\vert}}{CH}]_9NH_2$ |

These components may be commercially available or they may be readily synthesized (qv. for example U.S. Pat. No. 3,231,619 inter alia). The compound A for example may be commercially available under the trademark Jeffamine M-360.

These compounds may be added to lubricating oil in minor, effective, rust inhibiting amount of about 0.1–5 w%. Lesser quantities may be employed, but the degree of improvement so obtained may be lessened thereby. Larger amounts may be employed, but no significant additional improvement is thereby attained. Preferably the effective amount is about 0.1–5 w%, preferably 0.5–2%, say about 1 w% based on the lubricating oil.

The compound may be added separately or as a component of an additive package which contains other additives.

Presence of this compound in a crankcase lubricating oil is found to be particularly advantageous in several respects. It minimizes haze in the oil. Haze may be determined by visual inspection or by colorimetric techniques. In the Lumetron Turbidity Test, a standard light beam is passed through a sample to be tested and the amount of light which passes through the sample is measured by a photo cell. Results are obtained as % readings. A high reading of say 30 or above indicates substantial haze which is unsatisfactory. A low reading of 10–15 or below indicates a low level of haze which is satisfactory. As measured by the Lumetron Turbidity Test, practice of this invention may decrease the haze from an unsatisfactory reading of say 40–60 to a satisfactory level of say 5–10 in the case of marine diesel crankcase oil.

It will also permit attainment of satisfactory rust inhibition as measured by the Salt Water Rust Test ASTM-D-655. Oils which fail the Salt Water Rust Test may be improved by use of the instant additive to the point at which they pass the test.

It is highly desirable to obtain a rust inhibitor which does not contribute haze to the crankcase oil system, because haze is generally regarded as an index of deterioration of the oil.

Practice of this invention will be apparent to those skilled in the art from inspection of the following examples wherein, as elsewhere in this specification unless otherwise stated, all parts are parts by weight. In the formulae, unfilled valence bonds may be filled with hydrogen atoms.

DESCRIPTION OF SPECIFIC EMBODIMENTS

Example I*

In this control example, a standard, slow speed marine diesel engine crankcase lubricating oil was made up containing the following components:

| Component | Amount (parts) |
|---|---|
| (i) SNO-20 G, a paraffinic Solvent Neutral Oil having a viscosity at 100° C. of 6.65–7.15 SUS and a VI of ca 92 | 39.30 |
| (ii) SNO-50, a paraffinic Solvent Neutral Oil having a viscosity at 100° C. of 15.3–16.4 SUS and a VI of ca 93 | 55.80 |
| (iii) Oronite 218A brand of overbased sulfurized calcium alkylphenolate having a TBN of 147 - (detergent) | 3.60 |
| (iv) Zinc dialkyl dithiophosphate - the zinc salt of the reaction product of $P_2S_5$ and mixed $C_2$–$C_4$ alcohol (anti-wear and anti-oxidant) | 0.65 |
| (v) Vanlube NA brand of Dinonyl phenyl amine (anti-oxidant) | 0.30 |
| (vi) Surfonic N-60 Brand of Ethoxylated (6) nonyl phenol (anti-rust agent) | 0.35 |
| (vii) Dimethyl polysiloxane (silicone) (anti-foamant) | 150 ppm |

This formulation as so made up (which is representative of prior art marine diesel engine crankcase lubricating oils) was found to have Lumetron Turbidity of 55. This is unsatisfactory. If additional quantities of the Surfonic N-60 anti-rust additive more added, the haze would be worse i.e. the Lumetron Turbidity would increase.

Example II*

A control formulation was made up identical to that of Example I except that it did not contain the Surfonic N-60 brand of rust inhibitor.

The Lumetron Turbidity test showed a satisfactory rating of 6; but the Salt Water Rust Test showed a "Fail" rating.

Example III

In this example which sets forth the best mode presently known of carrying out the process of this invention, the formulation of Example II was made up and there was added thereto 1.00 w% of compound A of the Table supra—the Jeffamine M-360 brand of:

$$n\text{-}C_4H_9[OCH_2CH_2]_4[OCH_2\underset{\underset{CH_3}{\vert}}{CH}]_2NH_2$$

When subjected to the Lumetron Turbidity Test, the formulation received a rating of 6 which is satisfactory.

When subjected to the Salt Water Rust Test, the rating was "Pass".

Results comparable to those of Example III may be obtained if the additive is the following—(the composition being identified by the letters noted in the Table II supra—present in amount of 1 w%):

TABLE III

| EXAMPLE | ADDITIVE |
|---|---|
| IV | B |
| V | C |
| VI | D |
| VII | E |

Compounds falling outside the scope of this invention which fail the Salt Water Rust Test (at the 1% level) include:

| Example | Compound |
|---|---|
| VIII | $C_{10-12}[OCH_2\underset{\underset{CH_3}{\vert}}{C}H]_2NH_2$ |
| IX | $CH_3[OCH_2CH_2]_{19}[OCH_2\underset{\underset{CH_3}{\vert}}{C}H]NH_2$ |

Although this invention has been illustrated by reference to specific embodiments, it will be apparent to those skilled in the art that various changes and modifications may be made which clearly fall within the scope of this invention.

What is claimed:

1. A crankcase lubricating oil composition suitable for use in a slow-speed marine diesel engine crankcase comprising (i) a major portion of a mineral lubricating oil suitable for use as lubricant in the crankcase of a marine diesel engine; and (ii) a minor, effective rust-inhibiting amount of $$R[OCH_2CH_2]_a[OCH_2\underset{\underset{CH_3}{\vert}}{C}H]_bNR_2'$$

wherein R is alkyl, aralkyl, alkaryl, aryl, or cycloalkyl, R′ is hydrogen or alkyl, a is 1–10, and b is 1–15.

2. A crankcase lubricating oil composition as claimed in claim 1 wherein R is an alkyl group.

3. A crankcase lubricating oil composition as claimed in claim 1 wherein R is a $C_1$–$C_{12}$ alkyl group.

4. A crankcase lubricating oil composition as claimed in claim 1 wherein R is n-butyl.

5. A crankcase lubricating oil composition as claimed in claim 1 wherein at least one R′ is hydrogen.

6. A crankcase lubricating oil composition as claimed in claim 1 wherein both R′ groups are hydrogen.

7. A crankcase lubricating oil composition as claimed in claim 1 wherein R is an alkyl group and both R′ groups are hydrogen.

8. A crankcase lubricating oil composition as claimed in claim 1 wherein a is 1–4.

9. A crankcase lubricating oil composition as claimed in claim 1 wherein b is 1–9.

10. A crankcase lubricating oil composition as claimed in claim 1 wherein said minor, effective, rust-inhibiting amount is 0.1–5 w%.

11. A crankcase lubricating oil composition as claimed in claim 1 wherein said minor, effective, rust-inhibiting amount is 0.5 w%–2 w%.

12. A crankcase lubricating oil composition as claimed in claim 1 wherein said minor, effective, rust-inhibiting amount is about 1 w%.

13. A crankcase lubricating oil composition, suitable for use in a slow-speed marine diesel engine crankcase, comprising (i) a major portion of a mineral lubricating oil suitable for use as lubricant in the crankcase of a marine diesel engine; and (ii) a minor, effective, rust-inhibiting amount of 0.1–5 w% of $$C_4H_9-[OCH_2CH_2]_4[OCH_2\overset{\overset{CH_3}{\vert}}{C}H]_2NH_2$$

14. The method of preparing a lubricating oil composition characterized by its rust-inhibiting properties, suitable for use in a slow-speed marine diesel engine crankcase, which comprises adding to a major portion of a mineral lubricating oil, suitable for use as lubricant in the crankcase of a marine diesel engine, a minor effective rust-inhibiting amount of 0.1–5 w% of $$R[OCH_2CH_2]_a[OCH_2\underset{\underset{CH_3}{\vert}}{C}H]_bNR_2'$$

wherein R is alkyl, aralkyl, alkaryl, aryl, or cycloakyl, R′ is hydrogen or alkyl, a is 1–10, and b is 1–15.

* * * * *